US005574794A

United States Patent [19]

Valley

[11] Patent Number: 5,574,794

[45] Date of Patent: Nov. 12, 1996

[54] MICROPHONE ASSEMBLY FOR ADHESIVE ATTACHMENT TO A VIBRATORY SURFACE

[75] Inventor: Robert A. Valley, Branford, Conn.

[73] Assignee: Earmark, Inc., Hamden, Conn.

[21] Appl. No.: 375,341

[22] Filed: Jan. 19, 1995

[51] Int. Cl.[6] ..... H04R 25/00

[52] U.S. Cl. ..... 381/169; 381/157; 381/168; 128/201.19

[58] Field of Search ..... 381/75, 168, 169, 381/157, 183, 187; 128/201.19, 205.25; 181/21, 22; 2/906, 424, 422; 379/175, 430; 367/132

[56] References Cited

U.S. PATENT DOCUMENTS

| | | | |
|---|---|---|---|
| 2,942,072 | 6/1960 | Cunningham | 179/156 |
| 3,723,670 | 3/1973 | Sebasta et al. | 179/156 |
| 3,816,671 | 6/1974 | Fraim et al. | 179/111 E |
| 3,946,422 | 3/1976 | Yagi et al. | 357/26 |
| 4,014,091 | 3/1977 | Kodera et al. | 29/592 |
| 4,047,998 | 9/1977 | Yoshikawa et al. | 156/275 |
| 4,471,174 | 9/1984 | Nava | 179/156 R |
| 4,491,699 | 1/1985 | Walker | 179/102 |
| 4,495,641 | 1/1985 | Vernino | 381/91 |
| 4,508,936 | 4/1985 | Ingalls | 179/82 |
| 4,520,238 | 5/1985 | Ikeda | 179/121 C |
| 4,626,729 | 12/1986 | Lewiner et al. | 310/324 |
| 4,718,415 | 1/1988 | Bolnberger | 128/201.19 |
| 4,799,263 | 1/1989 | Bänziger et al. | 381/94 |
| 4,926,398 | 5/1990 | Fincher | 128/201.19 |
| 5,054,079 | 10/1991 | Frielingsdorf et al. | 381/151 |
| 5,168,525 | 12/1992 | Müller | 381/91 |
| 5,280,524 | 1/1994 | Norris | 379/387 |

FOREIGN PATENT DOCUMENTS

| | | | |
|---|---|---|---|
| 2064263 | 6/1981 | United Kingdom | 381/168 |

*Primary Examiner*—Curtis Kuntz
*Assistant Examiner*—Huyen D. Le
*Attorney, Agent, or Firm*—McCormick, Paulding & Huber

[57] ABSTRACT

A microphone assembly suitable for use with a face mask has a cylindrical housing with an inwardly extending recess at its front end covered by a first diaphragm. A microphone unit carried by the housing has a diaphragm communicating with the recess, and the recess and the two diaphragms define an airtight chamber containing a trapped quantity of air transmitting vibrations of the first diaphragm to the microphone diaphragm. A doubly adhesively sided pad comprising a layer of plastic closed cell foam material and two adhesive films provides an intimate vibration transmitting interface, free of air flow passages or pockets, between the diaphragm and a supporting surface.

16 Claims, 1 Drawing Sheet

MICROPHONE ASSEMBLY FOR ADHESIVE ATTACHMENT TO A VIBRATORY SURFACE

BACKGROUND OF THE INVENTION

The present invention relates generally to the field of voice communication devices; and deals more specifically with a microphone assembly for adhesive attachment to an external surface of a face mask or other vibratory surface excited by human voice.

The microphone assembly of this invention is especially well suited for use in combination with a face mask wherein it is attached to an external surface of the mask vibrated by the voice of the person wearing the mask. The microphone assembly of the invention is therefore illustrated and described herein for convenience in connection with such application. It is to be understood, however, that use of the subject microphone assembly is not limited to face masks and that it may instead find use with other vibratory surfaces excited by human voice or by other sources with frequencies similar to those of human voice.

Face masks known in the prior art are commonly used by persons working in contaminated or hazardous atmospheres such as those sometimes found, for example, in nuclear material handling facilities or in fire fighting situations. These masks usually cover both the nose and mouth of the wearer and by some means permit the wearer to breathe while working with the mask in place.

It is often desirable that persons wearing masks of this type be able to communicate with other persons either nearby or at some remote location, and to meet this need various attempts have been made in the past to provide microphones for face masks to pick up the voices of the wearers and to convert the voice signals into electrical signals which are then amplified and transmitted by radio or other means to other persons or locations. Often these microphones are designed to be located inside of the face mask, which gives rise to problems in leading wires from the microphone to the outside of the mask without leakage of the surrounding atmosphere into the mask. Also the masks are often worn in noisy environments and it is desirable that the microphones used with them be relatively sensitive to the voices of the wearers while at the same time being relatively insensitive to background or ambient noises. Still further, if the masks are used in polluting or dirty atmospheres it is often necessary to periodically clean them and the associated microphones by perhaps washing them with water or other cleaning liquids, and the microphones accordingly should be ones capable of being immersed in the cleaning liquids without damage.

The general object of the invention is therefore to provide a microphone assembly for attachment to a member, such as the window of a face mask, vibratorily excitable by a human voice, to convert the vibrations of that element into electrical signals corresponding to the human voice signals and which microphone assembly overcomes the problems mentioned above.

A further object of the invention is to provide a microphone assembly of the foregoing character which is readily adhesively attachable to a face mask to pick up the wearer's voice without any special modification or adaptation of the face mask being required. In keeping with this object a more specific object of the invention is to provide a microphone assembly which can be readily attached to and removed from a face mask to allow the assembly to be removed and reattached to the face mask for cleaning purposes, to be removed for replacement by another assembly, or to be removed for reattachment to another face mask.

Other objects and advantages of the invention will be apparent from the following detailed description of a preferred embodiment and from the accompanying drawings and claims.

SUMMARY OF THE INVENTION

The invention resides in a microphone assembly, especially well suited for use with a face mask or other object vibrated by human voice, consisting of a housing of rigid material having a front end with an inwardly extending recess and a first diaphragm attached to the housing at its front end and hermetically sealing the recess, the housing also carrying a microphone unit including a case with an open end and a diaphragm extending across and hermetically sealing the open case end. The open end of the microphone case communicates with the housing recess, and the housing recess together with the first diaphragm and the diaphragm of the microphone unit define an airtight chamber so that the air contained in the chamber is of a fixed quantity and actively transmits vibrations of the first diaphragm to the microphone diaphragm.

The invention also resides in the volume of the airtight chamber being such in relation to the vibratory characteristics of the first diaphragm and of the microphone diaphragm that all or at least a substantial amount of the voice range of frequencies the impedances of the two diaphragms are well matched to provide an efficient transfer of vibrations of the first diaphragm to the microphone diaphragm.

The invention also resides in the microphone assembly being adhesively attachable to the external surface of a window of a face mask, or other vibratory element, by means of a relatively thin layer of closed cell plastic foam material having adhesive films on both of its major surfaces, one of the adhesive films serving to intimately attach the foam layer to the first diaphragm without air gaps or pockets between the foam layer and the diaphragm, and the second adhesive film likewise serving to intimately attach the foam layer to the external surface of the face mask window or the like without air gaps or pockets, to achieve a satisfactory coupling between the face mask window or the like and the first diaphragm of the microphone assembly.

The invention further resides in the mass relationship between the mass of the active portion of the first diaphragm and the remaining portion of the microphone assembly being such that the transmission of vibrations from the external surface of the face mask to the first diaphragm at frequencies below the desired voice range is significantly attenuated or cutoff to minimize the pick-up by the microphone unit of the assembly of low frequency background noise, and by the volume of the airtight chamber being sufficiently large that at vibratory frequencies of the first diaphragm above the desired voice range the transmission of vibrations from the first diaphragm to the microphone diaphragm is also significantly attenuated or cut off to minimize pick-up by the microphone unit of high frequency background noise.

The invention also resides in other details of the microphone assembly as mentioned in the accompanying claims.

DETAILED DESCRIPTION OF THE PREFERRED EMBODIMENT

Figure 1:
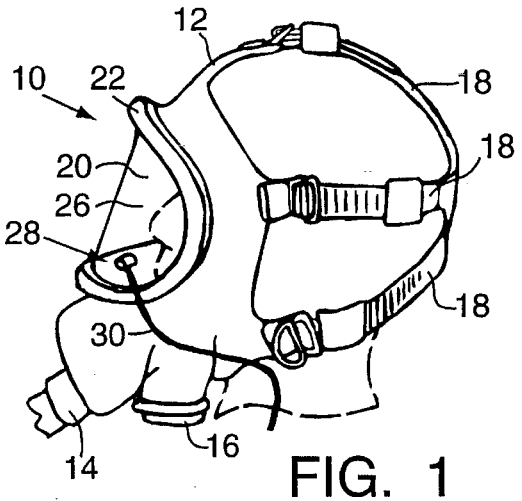
FIG. 1 is a schematic view of a generally conventional face mask equipped with a microphone assembly embodying the present invention.
Figure 4:
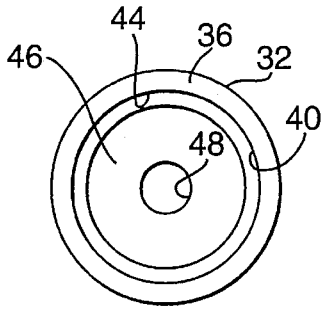
FIG. 4 is a front end view, in reduced scale, of the housing of FIG. 3.
Figure 5:
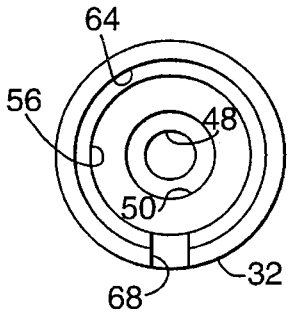
FIG. 5 is a rear end view, in reduced scale, of the housing of FIG. 3.

Turning to the drawings, a generally conventional face mask with which the microphone assembly of the present invention may be used is shown generally at 10 in FIG. 1. The mask 10 encloses the mouth of a wearer and has a body 12 made of rubber or other suitable material. An air supply or inhaling connection is indicated at 14 and an air exhaust or exhaling port is indicated at 16. The body 12 of the mask is held to a wearer's face and head by means of adjustable straps 18. The body 12 of the mask includes a bezel 22 sealingly holding a window 20 made of a relatively rigid transparent plastic material of generally uniform thickness and having a continuous smooth inner surface 24 and continuous smooth outer surface 26. A microphone assembly embodying the present invention is shown at 28 and is adhesively attached to the outer surface 26 of the mask window 20. A cable 30 is electrically and physically connected to the microphone assembly 28 and carries electrical signals produced by the assembly, corresponding to the voice of the mask wearer, to associated communication equipment (not illustrated) well known in the art, such as an amplifier and radio transmitter carried by the wearer.

The details of the construction of the microphone assembly 28 are shown in FIGS. 2–8. With references to these figures, the microphone assembly 28, in the illustrated and presently preferred embodiment, includes a cylindrical housing 32 having an axial length and outside diameter of 19/32 inch and having a front end 34 with an inwardly extending recess. This recess is made up of a forward cylindrical portion 44 of large diameter, a cylindrical rear portion 48 of small diameter, and a frustoconical middle portion 46, as seen best in FIG. 3. Forwardly of the recess portion 44 is another cylindrical recess 40, of larger diameter than the recess portion 44, which receives a first diaphragm 42. The diaphragm receiving recess 40 and the diaphragm itself have diameters of approximately ½ inch, and the recess portion 44 has a diameter of approximately 11/32nd inch. The diaphragm 42 therefore has an outer marginal portion engaging the housing along the annular ledge between the recess 40 and the recess portion 44 and an active portion located inside the marginal portion and covering the inwardly extending recess at the front end of the housing. The active portion of the diaphragm preferably has an area of between 0.070 in.$^2$ and 0.110 in.$^2$. In the illustrated case it has a diameter of 11/32nd inch and an area of approximately 0.090 inches and is free to vibrate relative to the housing. In the illustrated and preferred example the diaphragm is made of an acrylonitrile-butadiene-styrene copolymer (ABS) material and has a thickness of approximately 0.030 inch.

The diaphragm 42 is hermetically sealed to the housing as, for example, being bonded to the housing by means of a suitable "welding" type of adhesive which causes the housing and diaphragm materials to fuse to one another. In the presently preferred case, both the housing 32 and the diaphragm 42 are made of an acrylonitrile-butadiene-styrene copolymer (ABS) material and methyl-ethyl-keytone (MEK) cement is used to fusibly bond the diaphragm to the housing.

Figure 2:
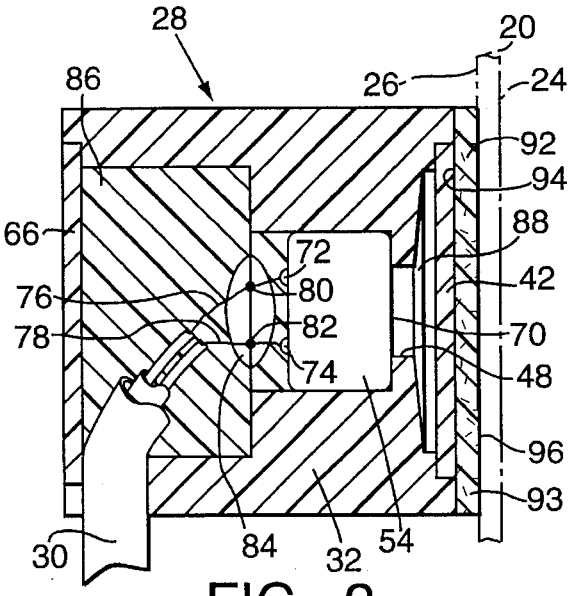
FIG. 2 is a cross sectional view taken through the microphone assembly of FIG. 1 on a plane containing its longitudinal axis.
Figure 3:
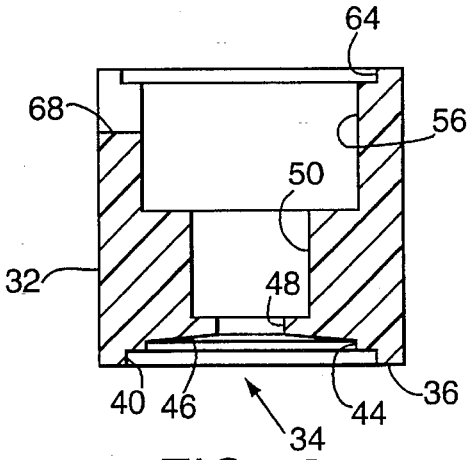
FIG. 3 is a view similar to FIG. 2 but showing only the housing member of the microphone assembly.

As seen in FIGS. 2 and 3, the housing 32 rearwardly of the small diameter portion 48 of the inwardly extending recess at the front end of the housing includes a first rear cylindrical recess 50, a second rear cylindrical recess 56 and a third rear cylindrical recess 64 of progressively increasing diameters. A microphone unit 54 is received in the first recess 50 and on its rear face has two output terminals 72 and 74 connected to two conductors 76 and 78 forming part of the cable 30 which enters the second recess 56 of the housing through a lateral slot 68. A radio frequency (RF) suppression capacitor 84 is also connected across the output terminals 72 and 74 of the microphone unit, as indicated at 80 and 82 and is located rearwardly of the microphone unit. The remaining space of the recesses 50 and 56 is filled with a suitable potting material 86, such as an epoxy material, to hermetically seal the microphone unit 54 to the housing and to prevent the entry of gaseous, liquid or solid contaminants into the housing. The rear end of the housing is covered by a disk shaped lid 66, made of ABS material, received in the recess 64 and fusibly secured to the housing by a suitable cement such as MEK.

Figure 6:
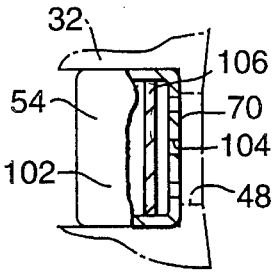
FIG. 6 is a side view of the microphone unit of FIG. 2 with part of the unit being shown broken away to reveal the open front end of the case and the adjacent microphone diaphragm.
Figure 7:
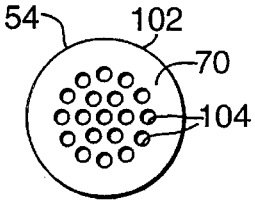
FIG. 7 is a front view of the microphone unit of FIG. 6.

As shown in FIGS. 2, 6 and 7, the microphone unit 54 includes a cup shaped metallic case 102 having a front end 70 with an effective acoustical opening defined by a clustered group of small openings 70. The front 104 of the unit is positioned adjacent the portion 48 of the rearwardly extending housing recess with the openings 104 communicating with that recess portion 48. Immediately behind the front wall 70 of the case 102 the microphone unit includes a vibratory diaphragm 106 hermetically sealed relative to the case 102.

From the foregoing it will be understood that since the front diaphragm 42 is hermetically sealed to the housing 32, since the case of the microphone unit 54 is hermetically sealed to the housing 32, and since the microphone diaphragm 106 is hermetically sealed to the microphone case, an airtight chamber 88 (FIG. 2) is defined by the inwardly extending recess of the housing (consisting of the recess portions 44, 46 and 48), by the first diaphragm 42 and by the microphone diaphragm 106. Therefore, provided the volume of this airtight recess is properly related to the sizes and vibratory characteristics of the first diaphragm 42 and the microphone diaphragm 106, the air trapped in the chamber 88 will act as a means for efficiently transferring the vibrations of the first diaphragm 42 to the microphone diaphragm 106. The proper volume of the chamber for a given set of diaphragms can be determined by trial and error techniques and is preferably chosen as one which provides an efficient transfer of those vibrations of the first diaphragm occurring within the frequency range of human voice.

As shown in FIG. 2, the microphone assembly 28 as so far described is attached to the exterior surface 26 of the face mask window 20 by a doubly adhesively sided adhesive pad 92. This pad is comprised of a layer 93 of closed cell plastic foam material having a first face covered by an adhesive film 94 and a second face covered by a similar adhesive film 96. The adhesive film 94 is used to adhere the pad 92 to the front face of the first diaphragm 42 and the second adhesive film 96 is used to adhere the pad to the window or other supporting surface 26. The films 94 and 96 are made of relatively aggressive permanently tacky adhesives so that the pad becomes intimately bonded to the diaphragm 42 and to the window surface 26 without any air gaps or pockets occurring between the pad and the diaphragm 42 or between the pad and the window surface 26. The front surface of the diaphragm 42 is planar, and one function of the pad 92 is to adapt this planar surface of the diaphragm to the possibly slightly curved condition of the window surface 26 at the point of the microphone assembly attachment. A thickness of the foam layer 93 of between 0.020 to 0.030 inches has been found to be satisfactory to accomplish this purpose while nevertheless, in combination with the closed cell construction of the foam material, adequately transmitting the vibrations of the supporting surface 26 to the diaphragm 42.

Figure 8:
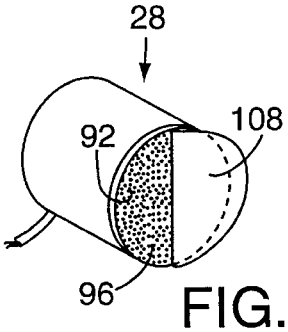
FIG. 8 is a perspective view of the microphone assembly of FIG. 1 showing the peeling away of the release layer on the front end of the assembly prior to the assembly being adhesively secured to the face mask.

As shown in FIG. 8, in many instances it is expected that the microphone assembly 28 of the invention will be made and sold as a component separate from a face mask with the intention of it being attached to a face mask or other supporting structure at a later time. When this is the case the assembly 28 preferably includes a layer 108 of release material covering the adhesive film 96 on the forward face of the pad 92, the layer 108 of release material being peelable from the adhesive film 96, as shown in FIG. 8, immediately prior to the attachment of the assembly to a supporting surface. As an alternative to this the assembly 28 may also be made and sold without any pad 92 being attached to its forward end and with one or more separate pads being provided with the assembly, each such separate pad having two layers of release material respectively covering its two adhesive films. Both the layers of release material are then removed from a pad when the microphone assembly is to be attached to a supporting surface, with the pad then being attached to the front end of the assembly and to the supporting surface by its two adhesive films.

With reference to FIG. 2, it should be observed that the front end of the housing 32 should not extend forwardly beyond the plane of the front face of the diaphragm 42 in order not to interfere with the attachment of the diaphragm to a supporting surface by the pad 92. In the preferred construction as shown in FIG. 2 the front end of the housing 32 has an annular front surface 36 coplanar with the front surface of the diaphragm 42 and the adhesive pad 92 extends over both the front face of the diaphragm and the annular surface 36 of the housing. This construction further assures the intimate sealing of the interface between the front face of the diaphragm 42 and the supporting surface 26 against the flow of air into and out of that interface, which is important to the invention as such air flow and/or lack of intimate contact between the pad 92 and the diaphragm 42 and surface 26 has been found to have a quite deleterious effect on the transmission of vibrations from the supporting surface to the diaphragm.

The materials used for the pad 92 are also preferably ones which allow the microphone assembly after its attachment to the surface 26 to be manually removed from that surface by a peeling type of manipulation with the material of the adhesive films 94 and 96 which then may remain on either the diaphragm 42 or the supporting surface 26 being easily removed by light scraping or rubbing, so as to allow the microphone assembly to be removed from the face mask for cleaning or other purposes and to then be replaced onto the same or other face mask with a new adhesive pad. As mentioned above, the foam layer of the pad preferably has a thickness of 0.020 to 0.030 inches. A suitable, and the presently preferred, material to use for the pad 92 is one available from 3M Corporation of Minneapolis, Minn. and is referred to as "Very High Bond Double Coated Acrylic Foam Tape"—Product No. 4932, said tape having a thickness of 0.025 inch.

Applicant has also discovered that the microphone assembly of the present invention and as described above can provide substantial immunity from external noises at frequencies both above and below the voice range desired to be picked by the assembly. Such immunity to external noise at frequencies below the voice range is dependent on the mass relationship of the active portion of the diaphragm 42 to the mass of the remaining portion of the assembly. This mass relationship can best be empirically determined by trial and error, but in general terms it has been found that the mass of the remaining portion of the assembly should be at least 50 times the mass of the active portion of the diaphragm 42. If the mass of the assembly is sufficiently low, at lower frequencies of vibration of the surface 26 the assembly will tend to move with the surface 26 with little or no relative motion occurring between the diaphragm 42 and the housing, and this sets the low frequency cutoff point of the assembly. At higher frequencies of vibration the housing of the assembly becomes relatively stable and does not move in sympathy with the surface 26 and therefore the diaphragm is vibrated relative to the housing with efficient transfer of vibrations from the supporting surface 26 to the diaphragm 42 and from the diaphragm 42 to the microphone diaphragm 106. At still higher frequencies the volume of air contained in the airtight chamber 88 is too large to efficiently transfer the vibrations of the diaphragm 42 to the microphone diaphragm 106, and this sets the upper frequency cutoff point.

Various different types of microphones may be used for the microphone unit 54, but preferably the unit 54 is a condenser microphone unit using an electret material to establish the required electrostatic field. The presently preferred microphone unit is one available from Primo Company, Ltd. of 1805 Couch Drive, McKinney, Tex. 75069 and is identified as Model No. EM-123.

I claim:

1. A microphone assembly for adhesive attachment to a vibratory surface, said assembly comprising:

a housing of rigid material having a front end and a recess extending inwardly from said front end, a first diaphragm attached to said front end of said housing so as to hermetically seal said recess at said front end of said housing, said first diaphragm having a front face located in a given plane and said housing not extending forwardly beyond said plane, and a microphone unit carried by said housing, said microphone unit including a case having an open end and a microphone diaphragm carried by said case said microphone diaphragm is positioned near said open end of said case and extends across and hermetically seals said open end of said case, said open end of said case communicating with said housing recess and said case being hermetically sealed to said housing so that said housing recess, said first diaphragm and said microphone diaphragm define together an airtight chamber containing a fixed quantity of air, said chamber being of such volume that the air contained therein efficiently transfers vibrations of said first diaphragm to said microphone diaphragm at frequencies within the frequency range of the human voice.

2. A microphone assembly as defined in claim 1 further comprising a layer of plastic closed cell foam material covering said front face of said first diaphragm, said layer of foam material having a rear face facing said front face of said first diaphragm and a front face facing in the same direction as said front face of said first diaphragm, a first film of adhesive between said front face of said first diaphragm and said rear face of said layer of foam material adhesively bonding said layer of foam material to said first diaphragm, and a second film of adhesive covering said front face of said layer of foam material.

3. A microphone assembly as defined in claim 2 further comprising a layer of release material covering said second film of adhesive on said front face of said foam material said layer of release material is removable to expose said second adhesive film for use in attaching said microphone assembly to said vibratory surface.

4. A microphone assembly as defined in claim 2 wherein said first diaphragm has a marginal portion fixed to said housing and an active portion inside of said marginal portion extending over said recess and unattached to said housing so as to be vibratory relative to said housing, said active portion of said first diaphragm having an area between 0.070 in.$^2$ and 0.110 in.$^2$, and said layer of plastic closed cell foam material having a thickness of 0.020 to 0.030 inches.

5. A microphone assembly as defined in claim 4 wherein said first diaphragm has a thickness of approximately 0.030 in and is made of ABS material.

6. A microphone assembly as defined in claim 4 wherein said plastic closed cell foam material is a foamed acrylic material.

7. A microphone assembly as defined in claim 4 wherein said first diaphragm is circular in shape, said housing recess adjacent said first diaphragm and said active portion of said first diaphragm both have a diameter of approximately 0.340 in., and said diameter throughout said active portion has a thickness of approximately 0.030 in.

8. A microphone assembly as defined in claim 7 wherein said first diaphragm is made of ABS material.

9. A microphone assembly as defined in claim 7 further comprising a layer of resilient plastic closed cell foam material covering said front face of said first diaphragm, said layer of foam material having a rear face facing said front face of said first diaphragm and a front face facing in the same direction as said front face of said first diaphragm, a first film of adhesive between said front face of said first diaphragm and said rear face of said layer of foam material adhesively bonding said layer of foam material to said first diaphragm, and a second film of adhesive covering said front face of said layer of foam material.

10. A microphone assembly as defined in claim 9 further comprising a layer of release material covering said second film of adhesive on said front face of said foam material, said layer of release material is removable to expose said second adhesive film for use in attaching said microphone assembly to a vibratory surface.

11. A microphone assembly as defined in claim 9 wherein said microphone assembly, apart from said active portion of said first diaphragm and apart from said layer of foam material and said two films of adhesive associated with said layer of foam material, has a mass at least 50 times greater than the mass of said active portion of said diaphragm.

12. A microphone assembly as defined in claim 9 wherein said front end of said housing has an annular front surface located in said given plane and surrounding said first diaphragm, and said layer of foam material covers both said front face of said first diaphragm and said annular front surface of said housing.

13. A microphone assembly as defined in claim 1 wherein said microphone unit is a condenser microphone unit.

14. A microphone assembly as defined in claim 13 wherein said condenser microphone unit is an electret condenser microphone unit.

15. A microphone assembly as defined in claim 2 further characterized by said microphone assembly having such mass that when said assembly is attached to said vibratory surface by means of said second film of adhesive at frequencies of said vibratory surface below the frequency range of the human voice, said housing tends to move in sympathy with the movement of said vibratory surface so that the transmission of vibrations of said vibratory surface to said first diaphragm at said frequencies below said frequency range of the human voice is attenuated.

16. A microphone assembly as defined in claim 1 wherein the volume of said airtight chamber is sufficiently large that at frequencies above the frequency range of the human voice, the quantity of air contained in said airtight chamber is less efficient in transmitting vibrations of said first diaphragm to said microphone diaphragm.

* * * * *